United States Patent [19]

Randall

[11] 4,061,379

[45] Dec. 6, 1977

[54] LOCKER SYSTEM

[76] Inventor: Lee S. Randall, 222 Crampton Drive, Monroe, Mich. 48161

[21] Appl. No.: 756,120

[22] Filed: Jan. 3, 1977

[51] Int. Cl.[2] ..... A47B 53/00

[52] U.S. Cl. ..... 312/201; 312/250; 312/320; 52/29

[58] Field of Search ..... 312/198, 201, 209, 250, 312/320, 267; 214/16 B, 16.1 C, 16.1 CA; 52/29 X, 32, 33, 36

[56] References Cited

U.S. PATENT DOCUMENTS

| | | | |
|---|---|---|---|
| 1,875,383 | 9/1932 | La Porte | 312/199 |
| 2,166,704 | 7/1939 | Foulkes | 214/16 B |
| 3,467,461 | 9/1969 | Hauser | 312/320 |
| 3,967,868 | 7/1976 | Baker, Jr. | 312/250 |

FOREIGN PATENT DOCUMENTS

| | | | |
|---|---|---|---|
| 262,746 | 11/1965 | Australia | 312/201 |

*Primary Examiner*—Casmir A. Nunberg

*Attorney, Agent, or Firm*—Owen, Purdue, Emch & Barker

[57] ABSTRACT

A locker or stowage system particularly suited for athletic or school use is disclosed. The system includes a plurality of adjacent rows or tiers made up of a number of adjacent lockers or individual stowage compartments with access to each compartment provided on the lateral face of each tier. The tiers of compartments are positioned side-by-side with their lateral faces closely adjacent and each tier is adapted to individually move relative to one another, in a direction parallel to the lateral faces, between a closed, retracted position and an open, extended position. The installed system can be fully closed with all tiers in retracted position to eliminate access to all lockers or comparements. When selected or alternate tiers are moved to open position, access to lockers in those extended tiers is provided in the space between such alternate tiers defined by the width of the still closed or retracted tiers. Suitable means are provided for guiding the movement of such tiers from their retracted to extended positions and for locking the tiers in closed position to prevent unauthorized opening.

13 Claims, 5 Drawing Figures

LOCKER SYSTEM

BACKGROUND OF THE INVENTION

This invention relates to a locker room system particularly adapted for use in schools or other athletic gymnasiums or swimming facilities which would have a locker room for storage of sport or street clothes as an adjunct to the facility.

Locker rooms adjacent such facilities which require the change of street clothes into athletic apparel have long been an adjunct and necessary part of any school or other athletic facility. With increased precautions being taken against theft, the cost of such conventional facilities suited to serve increased numbers of users has become an important design factor in new facilities, as well as the relative increase in labor costs required for cleaning and maintaining such facilities. With total space consumed being another important factor, the art of designing lockers or similar shelves has attempted to reach efficient solutions in several ways. For example, a number of U.S. patents including U.S. Pat. Nos. 2,707,442, 3,427,085 and 3,597,034 disclose shelving systems for library books, small parts and the like, in which a plurality of rows of shelves are adapted to slide toward and away from each other in a direction normal to the open face of the shelves. With such systems, an aisle between two facing shelf rows can be created to give access to those exposed shelves; by sliding one shelf to close that aisle, another aisle on the opposite side thereof can be created, etc. While such a system is particularly useful in some installations where only a single person is seeking access to a particular shelf, it is not particularly desirable in an environment where a large number of persons would be seeking access to the contents of various shelves at one time, since only one aisle at one time can be created according to this system.

Another system is shown in U.S. Pat. No. 1,875,383 in which paired rows of lockers may be pivoted about a vertical axis to open or close off access to these lockers. Such a system does facilitate the preventing unintentional access to the lockers or basket therein, but does not save any floor space and creates a somewhat awkward use pattern for the users.

Still another approach is shown in U.S. Pat. No. 2,847,265 in which a plurality of sliding compartments or clothes containers are positioned in a circular pattern around a common access and are movable from a closed position to an open position along a radial path. Like the aforesaid system of U.S. Pat. No. 1,875,383, this system provides a round pattern for the users and cannot be conveniently adjusted to a normal rectangular locker room without using much valuable space.

BRIEF DESCRIPTION OF THE INVENTION

In the invention of the present locker system, a plurality of side-by-side rows of locker units is provided, with each of the individual lockers in a row having an access opening or door in the lateral faces of the rows. The rows are closely spaced together so that, when the rows are in side-by-side or closed alignment, access to each of the individual lockers is impossible. Each of the rows are individually provided with guide means, such as a suspension track or floor track so that each row is slidable relative to the other rows in a direction parallel to the lateral faces thereof. When the system is installed in a conventional rectangular locker room, the exposed end faces of the rows are placed along a wall with the rows extending into a rectangular opening within the wall so that, when all of the rows are in closed, retracted position, there is no access to any of the lateral faces of the rows and the room space is free and clear of any protruding apparatus. When one or more of the rows is slidably moved out of the rectangular opening to its open, extended position, its lateral faces become exposed to a user within the locker room. For example, if every other row is moved to its open, extended position, each lateral face of all such extended rows is exposed to a user within the locker room because a space or aisle the width of a non-extended row is provided between such alternate rows.

The advantages of this system will be apparent to those skilled in the art, from the following description of a preferred embodiment thereof, with reference being made to the accompanying drawings.

DETAILED DESCRIPTION OF A PREFERRED EMBODIMENT

Figure 1:
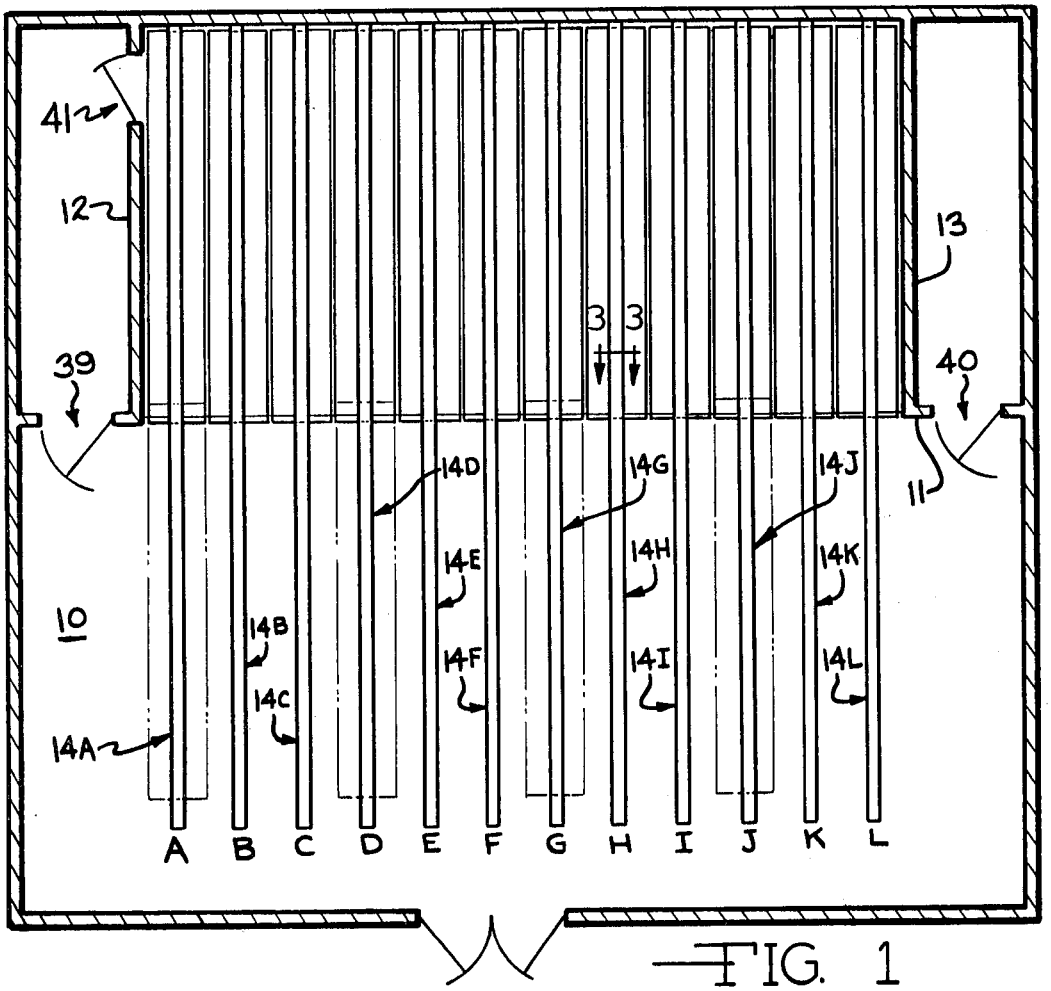
FIG. 1 is a plan view of the locker system of this invention, shown as would be placed within a rectangular locker room, having a wall with a rectangular aperture therein into which the retracted locker rows are placed.
Figure 4:
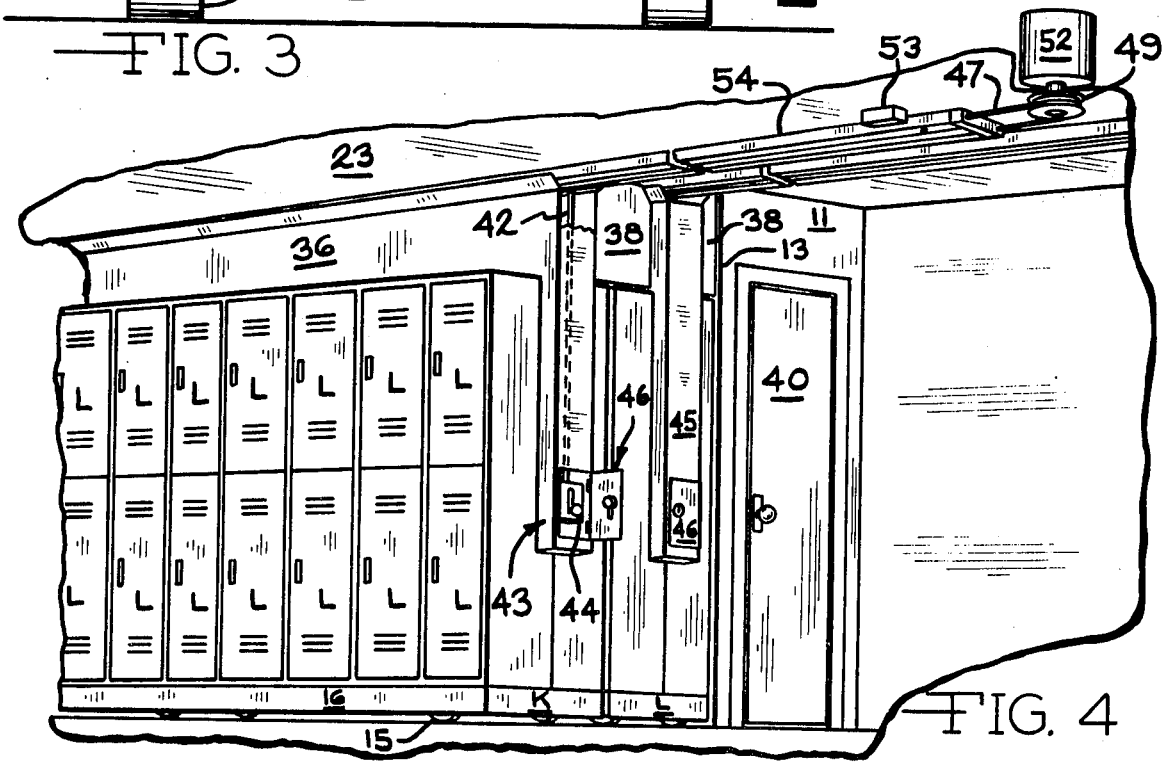
FIG. 4 is a partial view in perspective of the locker system shown in FIG. 1 and illustrating further details of the guide and locking mechanism for the rows of lockers.

Referring first to FIG. 1, a generally rectangular locker room or stowage space 10 is shown with an interior wall 11, also seen in FIG. 4, separating the inhabited space of the locker room 10 from the locker row storage space which is generally defined by interior walls 11, 12 and 13. The locker system shown in FIG. 1 consists of twelve separate rows or tiers of lockers A–L which generally consist of two outwardly facing banks of conventional locker units, as best seen in FIG. 4. Referring to FIG. 4, the two rows K and L are illustrated and each consists of a left and right hand bank of either half or full length lockers (half length are illustrated) having individual doors which face the lateral sides of the rows K and L. As will be understood by those skilled in the art, each of the individual lockers may be provided with a separate latching and locking mechanism if necessary or may merely be an open space provided with a basket or storage means with the access to that space extending on the lateral faces of each of the rows K and L.

Referring again to FIG. 1, each of the rows or tiers of lockers A–L are of identical length and extend from the interior wall 11 to the rear of the locker storage space at the top of the figure. Each of the locker rows A–L is provided with a track 14A–14L which will be later described in some detail, extending from the locker storage area at the top of FIG. 1 into the locker room 10 as shown. The length of the tracks 14A–14L are generally twice as long as the rows A–L so that each row moving along its track can be moved from its retracted position within the opening in wall 11 to a fully extended position as shown in broken line with respect to rows A, D, G and J. As will now be obvious from the above description, when such rows are moved to their extended position, the individual lockers on each bank on each side of these rows will be exposed to users within the locker room 10, while the individual lockers in closed, retracted rows, such as B, C, E, F, H, I, K and L in FIG. 1, remain out of the way and inaccessible to a user. It will now be seen that the system of this application provides a compact unit of high locker density which can be kept in closed, retracted position in which position the contents are protected from unauthorized access and in which position the entire locker room space 10 is open, free of obstruction and may be used for any purpose and easily cleaned and serviced. At the same time, when one or more of the rows of lockers A–L is moved to its open, extended position, every individual locker in that row is made accessible to users within the locker room 10 because of the space or aisle provided by the width of adjacent rows which remain in their retracted position.

Figure 2:
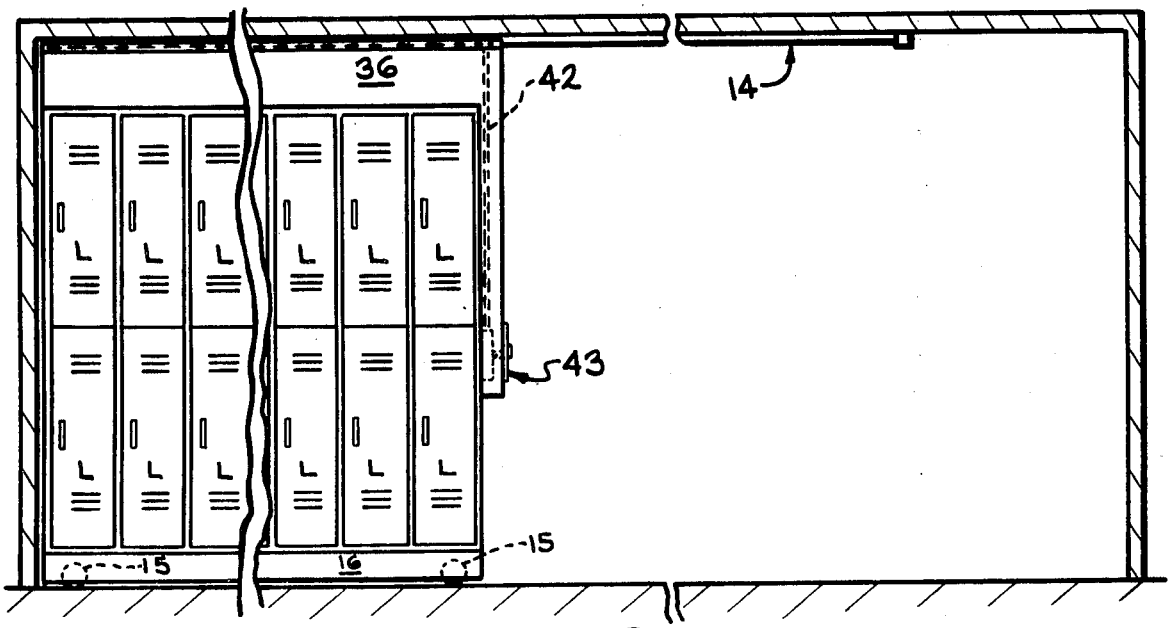
FIG. 2 is a view in elevation of the locker system shown in FIG. 1, showing the side view of a retracted row of lockers.

FIG. 2 illustrated the system with all of the rows A–L in retracted position, with the locker room space 10 being free and clear while FIG. 1 shows four of the 12 rows in extended position as would be the case when one-third of the total users of the locker room would be given access to their lockers.

Figure 3:
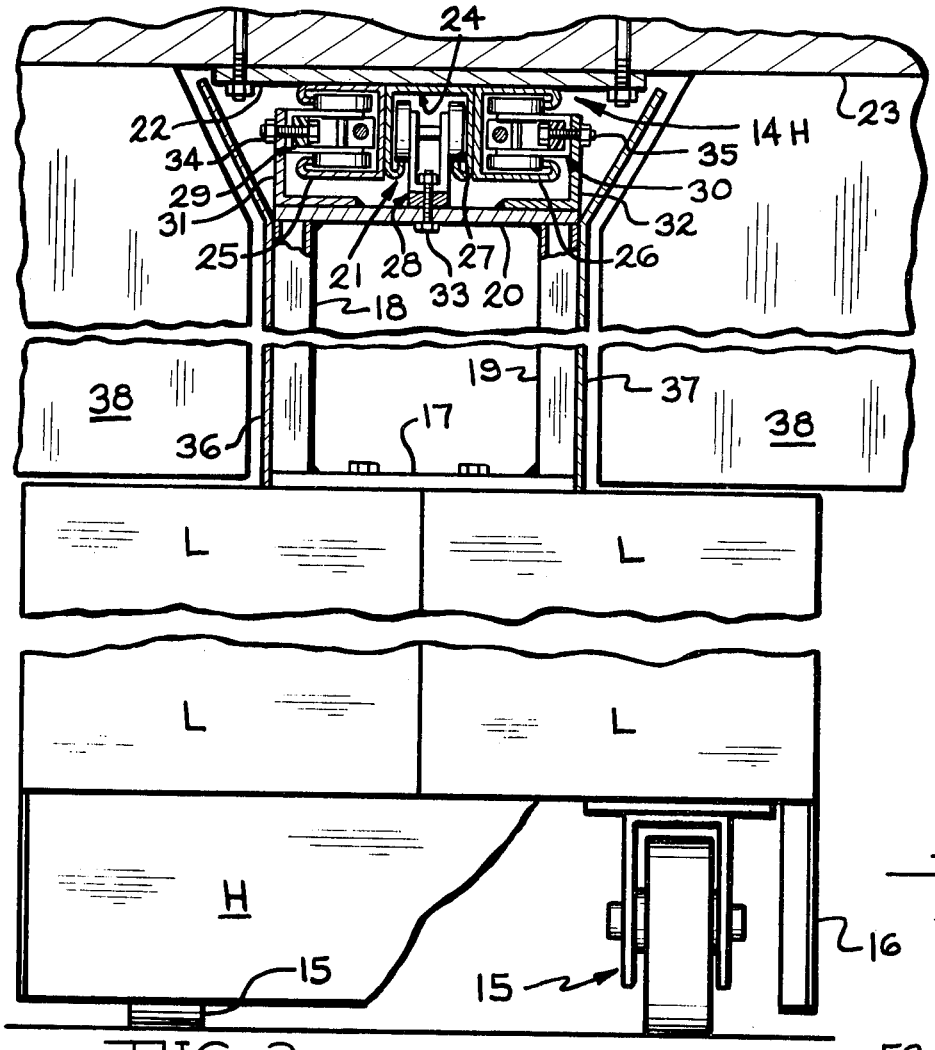
FIG. 3 is a cross sectional view, taken along line 3—3 of FIG. 1, and showing some of the details of the guide means for moving a row of lockers between its retracted and extended positions.

FIG. 3 illustrates in cross section, on a somewhat expanded scale, some of the details of the construction of a typical row of lockers H. The row H would include banks of lockers L as a rigid unit, with each of the lockers having a door or access opening on the lateral face of the row H. Supporting the lockers L in row H are a plurality of guide wheels 15 which are supported by the floor of the locker room 10 and which may be guided in a small recessed track (not shown) extending parallel to the path of movement of the rows. Such tracks are generally disadvantageous in some cases since they hamper cleaning the floor of the locker room 10 and also can be cluttered and obstructed with refuse. The wheels 15 are covered and shielded from view by a downwardly depending skirt 16 as also seen in FIG. 4. Rigidly secured to the uppermost surface of the lockers L in row H is a plate 17 extending along the length of the rows which may be bolted or otherwise secured to the tops of the individual lockers, depending upon the nature of their construction. Extending upwardly from the plate 17 are vertical beams 18 and 19 rigidly secured to the plate with their upper ends rigidly secured to a cross member 20 which in turn will support a roller mechanism generally designated by reference numeral 21. Depending upon the length of an individual locker row A–L, there should be at least two roller mechanisms of an identical nature positioned in alignment with one another above the plate 17 which will serve to guide the row of lockers in its movement along the tracks 14A–14L.

FIG. 3 shows a preferred embodiment of the guide track 14H and roller mechanism 21 which includes provision for supporting the weight of the row H and resisting lateral movement of the row H relative to the track. The track itself 14H is secured to a rigid plate 22 secured by bolts or other suitable fastening means to the overhead or ceiling 23 of the locker room 10. The track 14H may be an extruded multiple section having a downwardly extending central portion 24 opening on its lower side and a pair of side sections 25 and 26 having outwardly opening lateral sides as seen in FIG. 3. Each of the track portions 24–26 is generally U-shaped with the legs of the U having a return portion designated by reference numeral 27 turned inwardly within the U and providing a rail surface continuously along the length of the track.

A central roller carriage 28 is secured to the cross piece 20 and extends upwardly within the interior of the central portion 24 of the track. The roller carriage 28 includes a pair of spaced apart rollers which rides upon the return portion 27 of that track portion 24 as seen in FIG. 3. A pair of side roller carriages 29 and 30 are secured respectively to an opposed pair of upwardly extending flanges 31 and 32 which are rigidly secured to the upper surface of the cross piece 20. As thus described, the weight of the locker row H is principally supported by the central carriage 28 which rolls freely along the central portion 24 of the track 14H and the side roller carriages 29 and 30 are provided to limit lateral movement, in a horizontal plane normal to the track 14H. In the embodiment shown in FIG. 3, each of the roller carriages 28–30 is provided with a threaded type adjustment means 33–35 for aligning and positioning the rollers within the track, etc.

To protect the track and roller mechanism against obstruction and to shield it from view, a pair of upwardly extending angular flanges 36 and 37 are secured to the top of the row of lockers L along the length of that row and extend upwardly and thence outwardly toward the ceiling 23. These angular flanges 36 and 37 are also seen in FIG. 4 and provide in effect a continuous wall or barrier from the ceiling 23 down to the top of the lockers L which moves with the lockers L from their retracted, closed position to their open, extended position. FIG. 4 shows two of the rows K and L in fully closed or retracted position. In order to cover the space above the lockers 12 between the angular flanges 36 and 37, a face plate 38, also shown in FIG. 3, extends between the ceiling 23 and the top of the lockers L and is secured to the ceiling 23. The face plates 38 are positioned generally in the plane of the wall 11 so that, when all of the locker rows A–L are in their closed position, a barrier or room separator is formed by the ends of these rows, the face plate 38, and the wall 11. In the embodiment shown in FIG. 1, a door 39 and 40 is positioned on each side of the locker assembly through the wall 11. These doors provide access to a space adjacent interior walls 12 and 13 which can be used for equipment storage or any other convenient purpose. Also shown in FIG. 1 is a third door 41 through the interior wall 12 which provides access from the locker room 10 to the space behind the wall when the locker rows A–L are in their extended, open position. This is convenient for cleaning or maintenance purposes.

Referring again to FIG. 4, one type of locking mechanism for the rows K and L is schematically shown. As is discussed more fully below, it is desirable to provide a control system so that the movement of the rows A–L can be controlled only by authorized personnel in accordance with the scheduling of the users of the locker room. One such mechanical control system is schematically shown and includes a separate locking mechanism positioned on the end of each of the rows as shown in FIG. 4. A locking rod 42 extends vertically from the ceiling 23 downwardly to a control box 43 and is movable from an upper locked position to a lower open position by a handle 44. When in its upper locked position, the rod 42 extends into a recess within the fixed track and thus interferes with and prevents movement of that row of lockers. When the rod 42 is moved to its lower position, the row of lockers is free to move between its open and closed positions. The entire locking mechanism is enclosed in a vertically extending hood 45 with an access door 46 provided near the handle 44.

Figure 5:
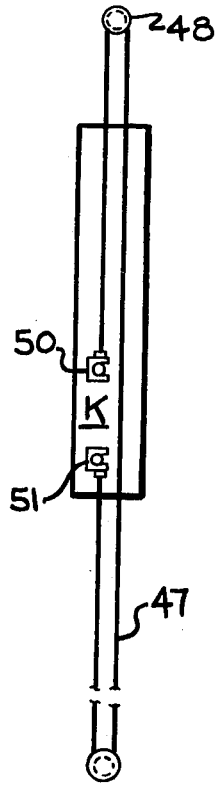
FIG. 5 is a schematic view of the drive mechanism for moving the rows of lockers as illustrated in FIG. 4.

FIGS. 4 and 5 schematically show a power operated mechanism for moving the rows of lockers between their closed, retracted position and their open, extended position. It should be understood that, depending upon the size and complexity of the installation, the invention herein described need not be power operated and the various rows of lockers A–L can be moved by hand. However, in a more complex and larger installation, it may be desirable to provide a power assist means in which one or more rows can be automatically opened or closed. One simple power assist means is schematically shown in FIG. 4 in which a cable 47 extends along the ceiling 23 above the row K and parallel to the track 14K. The cable 47 is directed around pulleys 48 and 49 rotatable about a fixed axis secured to the ceiling 23 at each end of its run. As schematically shown in FIG. 5, each end of the cable is secured by a clevis 50 and 51 supported by the upper surface of the locker row K so that movement of the cable in one direction is effective to move the locker row K outwardly and movement in the other direction will move the locker row K inwardly. As seen in FIG. 4, the pulley 49 is driven by a motor 52 which, through suitable electrical controls (not shown) can be driven in either direction to effect reciprocal movement of the locker row. A suitable stop mechanism such as a limit switch 53 would be positioned at each end of the cable run to stop the movement of the row in either its fully open or fully retracted position. As schematically shown in FIG. 4, a suitable protective cover 54 should be provided over the cable mechanism. It will be apparent to those skilled in the art that other more sophisticated drive mechanisms including hydraulic or electric power means can be used for effecting movement of the various rows of lockers.

In the above-described embodiment, it will now be apparent that the locker room system of this invention provides a number of distinct advantages over those known in the prior art. Firstly, when all of the locker rows A–L are in their closed, retracted position, the locker 10 itself is clear of any obstruction and may be used for instructional or other purposes. At the same time, unauthorized access to the contents of the lockers is positively prevented because they are inaccessible from the locker room space and are positively prevented from being opened or tampered with because of the close adjacency of the lateral surface of the next row of lockers.

This installation is particularly advantageous for use in education institutions in which different groups of users utilize the locker room at different times. For example, if the installation were provided in a locker room serving a school gymnasium, lockers in alternate rows A, C, E, etc., would be assigned to children scheduled to use the gymnasium during a first period. Prior to arrival of this first group of users, the attendant would unlock these alternate rows A, C, E, etc., and move them to their extended, open position. Thus, all the users during this first period would be provided with access to their own lockers while access to all other lockers would be prevented. Upon completion of the first period, the attendant would close these alternate rows A, C, E, etc., and open the rows of lockers assigned to the users in the following period, etc. Thus, the total number of lockers in a given space is markedly increased by use of this system and the appearance of the locker room for each group of users is essentially that of a conventional locker room with fixed rows of lockers separated by access aisles.

In addition, because the access to the lockers L is prevented when their rows are in closed position, it is unnecessary to provide conventional lockers with doors as are shown in the drawings, or to provide locks on such doors, and in certain installations a less expensive bank of compartments having baskets or other economical containers may be used, without fear of theft or unauthorized use of the equipment stored therein when the locker room is not in use.

Finally, it should be noted that the system described above is adaptable for use with any size of locker, half length or full length, and can be fabricated using existing locker designs and conventional hardware, and can be used equally well in new constructions or a remodeling of existing facilities.

Various other advantages will be apparent to those skilled in the art and variations to the above-described system may be made without departing from the spirit and scope of the attached claims.

I claim:

1. A multiple locker storage system comprising, in combination, a plurality of side-by-side adjacent rows of lockers with each row including a plurality of individual adjacent lockers having openings forming the lateral faces of each row, means for moving each row relative to the others in a direction parallel to their lateral faces from a retracted, closed position to an extended, open position, said lockers, when in said retracted, closed position defining a rectangular block with the exposed face thereof formed by the generally co-planar row ends defining a room wall preventing access to the lateral faces of said rows from said room, whereby, when all of said rows are in closed, retracted position said lateral faces of adjacent rows are closely adjacent and opposite each other to prevent access to the lockers therein and whereby, when selected row is moved to open, extended position, its lateral faces are exposed to provide access to the lockers in such extended row.

2. The multiple locker stowage system of claim 1 which includes a guide track for each row extending parallel to the lateral faces thereof and means for moving each of said rows along its guide track between said open and closed positions.

3. The multiple locker stowage system of claim 1 wherein the outer lateral face of the first and last rows of lockers is positioned, when in closed position, closely adjacent a fixed structural member covering said outer faces to thereby prevent access to the lockers therein.

4. The multiple locker stowage system of claim 1 which further includes a locking mechanism operable with each of said rows to prevent the unauthorized movement from closed to open position of each of said rows.

5. The multiple locker stowage system of claim 1 wherein said rows of lockers, when in retracted closed position, form a rectangular block with parallel lateral sides closely adjacent a fixed structural member and an exposed face formed by the ends of said rows.

6. The multiple locker stowage system of claim 1 wherein each of said rows of lockers has a plurality of individual lockers on both lateral sides thereof with a plurality of individual locker doors which, when closed, formed the lateral faces of each row whereby, when said locker doors are closed and said adjacent rows are in retracted, closed position, said locker doors are not accessible and are prevented from opening outwardly by the adjacent lateral face of the adjacent row.

7. In a locker room having an open floor area adjacent a vertical wall, the improvement comprising a rectangular opening in said wall, a plurality of rows of lockers in a closely adjacent side-by-side array positioned within said rectangular opening with the exposed ends of said rows being parallel and generally coplanar with said wall, the height of said rows and the width of said array of rows being generally coextensive with said rectangular opening such that said wall and said exposed row ends provide a generally closed vertical plane, each of said rows including a plurality of individual adjacent lockers having openings forming the lateral faces of said rows, means for selectively moving each of said rows in a direction parallel to its lateral face from a closed, retracted position within said rectangular opening to an open, extended position within said locker room beyond said wall whereby, (1) when any row is in retracted position within said rectangular opening, access is eliminated to the lockers therein from within said locker and (2) whereby, when any row is in extended position within said locker room with its next adjacent row remaining in closed position, access to the lockers in the former extended row is provided on the lateral face adjacent said latter closed row.

8. The combination of claim 7 in which each row of lockers is provided with a guide track extending parallel to the lateral faces thereof to guide such row between its said closed and open positions.

9. The combination of claim 8 wherein said guide track is secured in a fixed position above its locker row and extends lengthwise from said rectangular hole into said room space with a guide mechanism supported by and slidable relative to said track secured to and above said row of lockers whereby said row is supported by said track throughout its movement from closed to open positions.

10. The combination of claim 8 which further includes power drive means adjacent said guide track operable to move said row between its said closed and open positions.

11. The combination of claim 7 which further includes a means for locking said rows in their open and closed positions.

12. The combination of claim 11 wherein said locking means includes a mechanism secured to said exposed end of each of said rows which, in normal position, will prevent movement of said row from its fully closed or fully open position and which, when deactivated, will permit movement of said row.

13. A multiple row locker installation for use in an athletic locker room comprising, in combination, a plurality of closely adjacent side-by-side rows of lockers, each of said rows including an array of individual lockers whose openings form the lateral faces of said rows, each of said rows being slidable relative to each other in a path parallel to their lateral faces from a closed retracted position external of said locker room to an open position extending into said locker room whereby, when said rows are positioned in closed retracted position, access to the lockers therein from said locker room is prevented and whereby, when alternate or single rows of lockers are in open extended position within said room, access to lockers therein is permitted from within said locker room.

* * * * *